United States Patent [19]

McCullough

[11] 4,424,010

[45] Jan. 3, 1984

[54] INVOLUTE SCROLL-TYPE POSITIVE DISPLACEMENT ROTARY·FLUID APPARATUS WITH ORBITING GUIDE MEANS

[75] Inventor: John E. McCullough, Carlisle, Mass.

[73] Assignee: Arthur D. Little, Inc., Cambridge, Mass.

[21] Appl. No.: 312,745

[22] Filed: Oct. 19, 1981

[51] Int. Cl.[3] ..... F04B 17/00; F04C 2/02

[52] U.S. Cl. ..... 417/420; 418/55; 418/60; 464/103; 464/105

[58] Field of Search ..... 418/55, 60; 417/420; 464/102–105

[56] References Cited

U.S. PATENT DOCUMENTS

| | | | |
|---|---|---|---|
| 916,914 | 3/1909 | Cooley | 464/103 |
| 1,041,721 | 10/1912 | Ball | 418/55 |
| 1,884,976 | 10/1932 | Johnson | 464/103 |
| 3,011,694 | 12/1961 | Audemar | 418/55 |
| 4,013,384 | 3/1977 | Oikawa | 417/420 |
| 4,192,152 | 3/1980 | Armstrong et al. | 418/55 |

FOREIGN PATENT DOCUMENTS

| | | | |
|---|---|---|---|
| 980737 | 1/1951 | France | 418/55 |
| 5546081 | 9/1978 | Japan | 418/55 |
| 55-51982 | 4/1980 | Japan | 418/55 |

*Primary Examiner*—John J. Vrablik
*Attorney, Agent, or Firm*—Richard J. Hammond

[57] ABSTRACT

A scroll-type fluid motor or pump is provided with a roller Oldham coupling and bearing for guiding the orbiting scroll wrap relative to the fixed wrap, the coupling including plural, equal diameter cylindrical rollers disposed in overlapping but equally offset cylindrical openings forming bearing surfaces for the rollers. The diameter of each roller is such as to maintain the offset distance so that the orbiting scroll wrap is precisely guided relative to a fixed scroll wrap, whereby radial loads are fully carried by large rolling surfaces provided by the rollers. A magnetic drive system for the orbiting scroll is also disclosed.

6 Claims, 2 Drawing Figures

INVOLUTE SCROLL-TYPE POSITIVE DISPLACEMENT ROTARY FLUID APPARATUS WITH ORBITING GUIDE MEANS

BACKGROUND OF THE INVENTION

Positive displacement scroll-type fluid motors and pumps are extensively described in the prior art; for example see U.S. Pat. Nos. 3,011,694; 3,600,114; 3,802,809; 3,874,827; 3,884,599; 3,924,977; 3,986,799; 3,989,422; 3,994,633; 3,994,635; 3,994,636; 4,065,279; 4,129,405; 4,160,629; 4,192,152; and 4,259,043. Such apparatus in general is well known and devices of this type have spiroidal or involute interfitting surfaces called "wraps" of like pitch and arranged so that an orbitally moving wrap is displaced about an orbiting axis relative to a fixed wrap whereby a transfer of energy can occur between a fluid confined within the variable volume spaces between the relatively movable wraps and the orbiting scroll. Depending upon whether the device is a pump or a motor, the transfer of energy occurs from the orbiting wrap to the fluid or from the fluid to the orbiting wrap, respectively.

In such devices, it is well known that friction and wear must be minimized and various arrangements have been provided in the prior art for guiding the orbiting scroll relative to the fixed scroll to absorb the radial loads in the bearings whereby the contacting loads between the wraps is virtually eliminated or at least minimized. However, typical shortcomings of the prior art bearings include the requirement for lubrication, rather substantial strength, precise alignment, and structural integrity. Sealing problems are also encountered between the moving and stationary elements of scroll-type positive displacement rotary fluid devices of the prior art and suitable bearing arrangements for enabling such devices to operate in a totally hermetically sealed condition have been found to be lacking.

BRIEF SUMMARY OF THE INVENTION

The present invention is intended to overcome such shortcomings and contemplates the use of a roller type Oldham coupling between the orbiting and fixed scroll elements. Accordingly, the invention contemplates a positive displacement fluid apparatus comprising a fixed scroll having at least one involute wrap and an orbiting scroll having at least one involute wrap in mating engagement with the fixed involute wrap. The orbiting wrap is arranged to be orbitally driven relative to the fixed wrap to enable transfer of energy between a fluid confined between the fixed and orbiting wraps and the orbiting scroll. The orbiting scroll is guided for orbital movement relative to the fixed scroll by a rolling contact roller bearing arrangement comprising opposed pairs of fixed hollow cylindrical bearing surfaces having equal interior diameters that are concentrically disposed on axially opposite sides of the orbiting scroll. The axis of the pairs of fixed bearing surfaces extend parallel to the orbiting axis of the orbiting scroll and are located on a circumference of a circle that is concentric with the axis of orbiting movement of the orbiting scroll.

Orbiting hollow cylindrical bearing surfaces having a diameter equal to the diameters of the fixed bearing surfaces extend axially through and are connected with the orbiting scroll. The axes of the orbiting bearing surfaces extend parallel with the axes of the fixed pairs of opposed bearing surfaces and lie on a circumference of a circle that is equal in diameter to the first above mentioned circumference. Each axis of an orbiting cylindrical bearing surface is located adjacent to and offset in the same direction from the axis of a respective pair of fixed bearing surfaces by an equal offset distance that is less than the diameters of the cylindrical bearing surfaces, and a cylindrical roller bearing element is disposed within and extends between each of said pairs of fixed bearing surfaces while extending through a respective orbiting bearing surface. The roller bearing element has a diameter corresponding to that required to maintain the offset distance while the orbiting bearing surfaces are moved about their orbiting axis relative to the fixed bearing surfaces, whereby the orbiting scroll is precisely guided relative to the fixed scroll wraps for orbital movement with respect thereto.

The bearing arrangement is structurally rigid, geometrically precise, does not require lubrication since pure rolling motion is involved, provides large bearing surfaces for reacting the centrifugal bearing loads, and is structurally simple. Such a bearing arrangement lends itself readily to being hermetically sealed within a housing that is provided with suitable inlet and outlet ports for a fluid and enables a variety of driving arrangements for the orbiting scroll.

DESCRIPTION OF THE DRAWINGS

A specific embodiment of a scroll-type rotary fluid device incorporating the bearing of this invention is illustrated in the drawings accompanying the specification wherein.

DETAILED DESCRIPTION OF PREFERRED EMBODIMENT

Figure 1:
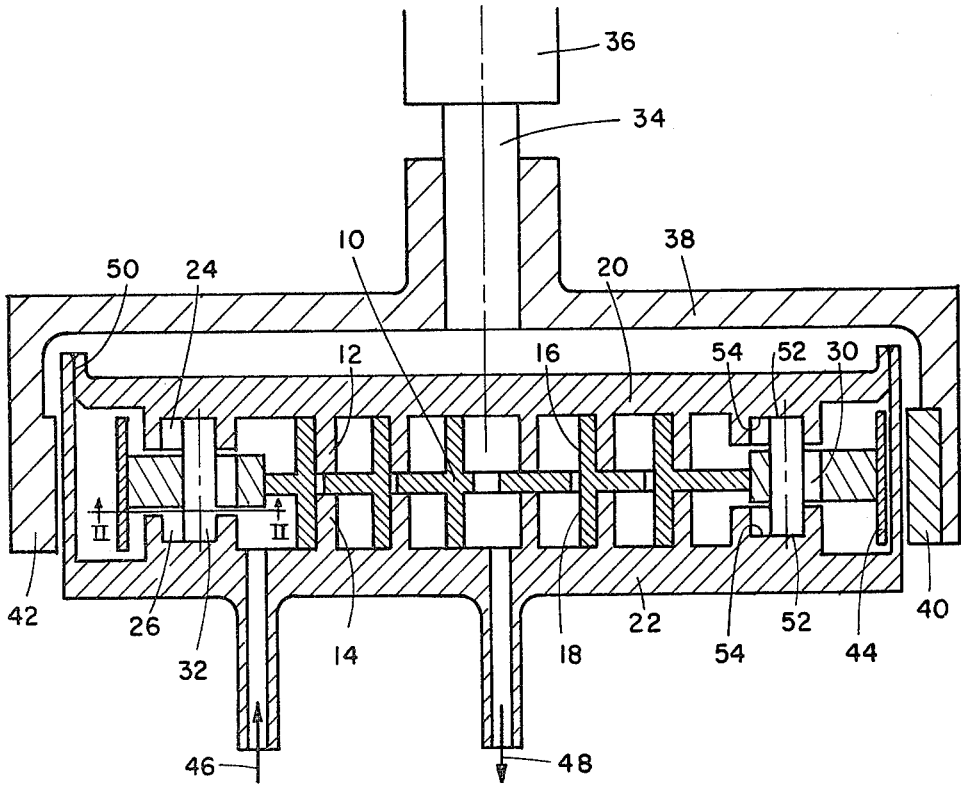
FIG. 1 is an elevational cross-sectional view of a magnetically driven scroll-type positive displacement pump using the bearing arrangement according to the present invention.

With reference to the drawings, an orbiting scroll member is generally indicated at 10 and includes mirror-image spiral wraps 16 and 18 on axially opposed sides thereof. The orbiting scroll 10 mates together with, in interfitting relationship as is known in the art, with fixed scroll wraps 12 and 14. Such interfitting wraps, for example, may be observed by reference to U.S. Pat. No. 4,192,152.

The orbiting scroll 10 is guided in an orbital path relative to fixed housing elements 20, 22 by a bearing arrangement comprising a roller Oldham coupling that includes opposed pairs of hollow cylindrical bearing surfaces 24, 26 in the fixed housing elements 20, 22, the opposed pairs of bearing surfaces 24, 26 all having equal interior diameters and being concentrically disposed on axially opposite sides of the orbiting scroll 10. The term "axially" is intended to mean generally parallel to the orbiting axis of the orbiting scroll. It will be seen that the axes of the opposed pairs of fixed bearing surfaces 24, 26 extend parallel to the orbiting axis of the orbiting scroll 10 and they are located on a circumference of a circle that is concentric with the orbiting axis of the orbiting scroll. A plurality of such opposed pairs of hollow cylindrical bearing surfaces 24, 26 are disposed in circumferentially spaced relationship about the said concentric circle and they are moreover located adjacent a peripheral area of the orbiting scroll 10 in the preferred embodiment.

Figure 2:
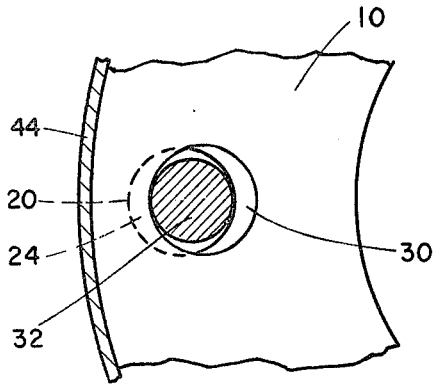
FIG. 2 is a view taken along FIG. II—II of FIG. 1.

The orbiting scroll 10 moreover is provided with hollow cylindrical bearing surfaces 30 extending therethrough, the orbiting bearing surfaces 30 having diameters equal to the diameters of the fixed bearing surfaces 24, 26. The axes of the orbiting bearing surfaces 30 extend parallel with the axes of the fixed pairs of bearing surfaces 24, 26 and lie likewise on a circumference of a circle that is equal in diameter to the above mentioned circumference. The orbiting bearing surfaces 30 each lie adjacent an opposed pair of fixed bearing surfaces 24, 26 and they are offset with respect to the fixed pairs by a distance that is less than the radius of the cylindrical bearing surfaces as seen in FIG. 2 (actually the offset is equal to the orbit radius of the orbiting scroll 10).

A cylindrical roller bearing element 32 is disposed within and extends between each of an opposed pair of fixed bearing surfaces 24, 26 and through a respective adjacent orbiting bearing surface 30. Each roller bearing element 32 has a diameter corresponding to that required to maintain the offset distance while the orbiting bearing surfaces are moved about their orbiting axis relative to the fixed bearing surfaces, whereby the orbiting scroll 10 is precisely located and guided for orbital movement relative to the housing elements 20, 22 and the fixed wraps 12, 14. In actuality, the diameter of each roller bearing element 32 is equal to the dimension of the diameter of the fixed bearing surfaces 24, 26 less the dimension of the orbit radius of the orbiting scroll 10.

The orbiting scroll 10 in this embodiment is driven by a magnetic coupling including a drive shaft 34 to which energy is supplied by a suitable drive mechanism 36, a frame 38 which carried a magnet 40 and a counterweight 42. The magnet interacts with a ring of ferromagnetic material 44 secured to or integral with the orbiting scroll 10. Rotation of the frame 38 will cause rotation of the orbiting scroll 10 due to the magnetic coupling between the magnet 40 and the ring 44. Of course, the relationship between driving and driven elements could be reversed if the orbiting scroll was driven by a pressurized fluid.

In this embodiment, the device is a pump and includes a fluid inlet 46 and a fluid outlet 48. Suitable transfer ports are provided through the orbiting scroll 10 for enabling communication between the mirror-image wraps 16, 18.

The housing elements 20, 22 may be hermetically sealed as shown by joining together the housing walls, for example as shown at 50. It will be evident that the rollers 32 can be provided with suitable end thrust bearing surfaces 52 of suitable configuration which cooperates with end surfaces 54 of cylindrical pairs of bearing surfaces 24, 26 to provide a fully retained bearing assembly.

Not shown in the drawing are connecting bolts that may be utilized to hold the housing walls 20 and 22 in spaced, parallel relationship. Such bolts would extend through larger openings provided in the peripheral area of the orbital scroll 10 and suitable axially extending spacers through which the bolts extend could be disposed within the opening extending through the orbiting scroll. The user of such connecting bolts will depend upon the specific applications of the scroll device.

It will be evident that the bearing coupling of the present invention provides large bearing surface for reacting centrifugal radial loads between the orbiting scroll and fixed housing and is of simple design permitting total hermetic sealing of the bearing structure. The bearing operates with pure rolling motion and is fully capable of operating without lubricants.

The foregoing description of a preferred embodiment is intended to be exemplary and is to be understood that the invention is not to be limited to the specifically disclosed embodiment but is to be accorded the full protection afforded by the scope of the following claims.

What is claimed is:

1. A positive displacement scroll-type fluid apparatus comprising:

a fixed scroll having at least one involute wrap;

an orbiting scroll having at least one involute wrap in mating engagement with the fixed involute wrap and arrangement to be orbitally driven about an orbital radius relative to the fixed wrap to enable transfer of energy between a fluid confined between the fixed and orbiting wraps and the orbiting scroll;

said orbiting scroll being guided for orbital movement and maintained in a predetermined angular orientation relative to the fixed scroll solely by a rolling contact bearing arrangement comprising opposed pairs of fixed hollow cylindrical bearing surfaces of equal interior diameter concentrically disposed on axially opposite sides of the orbiting scroll, the axes of said pairs of fixed bearing surfaces extending parallel to the orbital axis of the orbiting scroll and being located on a circumference of a circle that is concentric with the axis of orbiting movement of the orbiting scroll; orbiting hollow cylindrical bearing surfaces having diameters equal to the diameters of the fixed bearing surfaces extending axially through and being connected with the orbiting scroll, the axes of said orbiting bearing surfaces extending parallel with the axes of said fixed pairs of bearing surfaces, and lying on a circumference of a circle of equal diameter as the first said circumference; each axis of an orbiting bearing surface being located adjacent to and offset in the same direction from the axis of respective pairs of fixed bearing surfaces by an equal offset distance that is equal to said orbital radius; and an orbiting cylindrical roller bearing element disposed in and extending between each of said pairs of fixed bearing surfaces and through a respective orbiting bearing surface, the roller bearing element having a diameter corresponding to the difference between the diameter of said fixed bearing surfaces and said orbital radius, said rolling contact bearing carrying and reacting substantially all centrifugal radial loads of the orbiting scroll.

2. A positive displacement fluid apparatus as claimed in claim 1, said involute wraps and bearing arrangement being enclosed within a common housing.

3. A positive displacement fluid apparatus according to claim 1 or 2, including drive means for said orbiting scroll, said drive means being physically unconnected to said orbiting scroll.

4. A positive displacement fluid apparatus in accordance with claim 1, said opposed pairs of fixed bearing surfaces including end surfaces; said roller bearing elements including end thrust bearing means cooperating with said end bearing surfaces, whereby the axial movement of said roller bearing elements is constrained.

5. A positive displacement fluid apparatus in accordance with claim 1, said orbiting scroll including mirror-image wraps on the central portion of axially opposite sides thereof, said fixed scroll including two involute wraps mating with said mirror-image wraps, the roller bearing elements of said bearing arrangement being disposed adjacent the peripheral areas of said orbiting scroll outside said central portion with said fixed bearing surfaces disposed in the opposed fixed involute wraps.

6. A positive displacement fluid apparatus in accordance with claim 1 or 5, said orbiting scroll including a magnetic element, and a drive means for the orbiting scroll, said drive means including a complimentary magnetic element that is attracted to the orbiting scroll magnetic element and is rotatable about a center of rotation that is concentric with the fixed scroll, said complimentary magnetic element movable in a circular path that lies closely adjacent the path of motion of said magnetic element of the orbiting scroll.

* * * * *